United States Patent [19]

Arnold

[11] Patent Number: 4,817,888

[45] Date of Patent: Apr. 4, 1989

[54] MULTIPLE SPINDLE WINDING MACHINE FOR ELECTRIC COILS

[75] Inventor: Ernst Arnold, Buchs, Switzerland

[73] Assignee: Meteor AG, Ruschlikon, Switzerland

[21] Appl. No.: 60,319

[22] Filed: Jun. 10, 1987

Related U.S. Application Data

[63] Continuation-in-part of Ser. No. 854,485, Apr. 22, 1986, abandoned.

[51] Int. Cl.[4] ..... H01F 11/04

[52] U.S. Cl. ..... 242/7.09; 29/605

[58] Field of Search ..... 242/7.09, 7.11, 7.14, 242/7.17, 7.18; 140/92.1, 92.2; 29/605

[56] References Cited

U.S. PATENT DOCUMENTS

| | | | |
|---|---|---|---|
| 3,314,456 | 4/1967 | Cartwright et al. | 242/7.09 X |
| 3,878,602 | 4/1975 | Schubert et al. | 242/7.11 X |
| 4,157,165 | 6/1979 | Bierman et al. | 242/7.09 |
| 4,586,645 | 5/1986 | Haroda | 242/7.11 X |

FOREIGN PATENT DOCUMENTS

| | | | |
|---|---|---|---|
| 2363626 | 6/1974 | Fed. Rep. of Germany | 242/7.09 |
| 2443313 | 3/1976 | Fed. Rep. of Germany . | |
| 3312536 | 6/1984 | Fed. Rep. of Germany . | |
| 3333605 | 4/1985 | Fed. Rep. of Germany . | |
| 2140468 | 1/1986 | United Kingdom . | |

*Primary Examiner*—David Werner

*Attorney, Agent, or Firm*—Burns, Doane, Swecker & Mathis

[57] ABSTRACT

A multiple spindle winding machine includes a conveyor belt for advancing a plurality of workpiece carriers frictionally engaged thereto to a winding station and a processing station. Each workpiece carrier includes at least two spaced apart coil holding fixtures rigidly secured to a base plate and cooperable with the winding station. A lifting device having guide rails laterally displaced from the conveyor elevates one of the workpiece carriers from the conveyor belt to the winding station. The winding station includes a wire guide and a cutting device mounted to a pivotable arm for providing wire to be wound around a coil. Wire residue is collected by a holding pin positioned on the workpiece carrier.

5 Claims, 4 Drawing Sheets

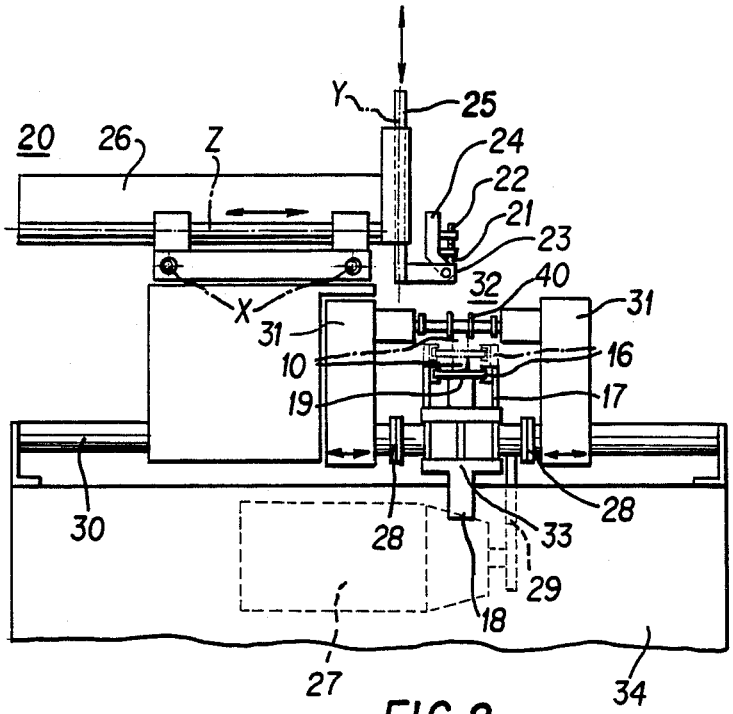
FIG.2
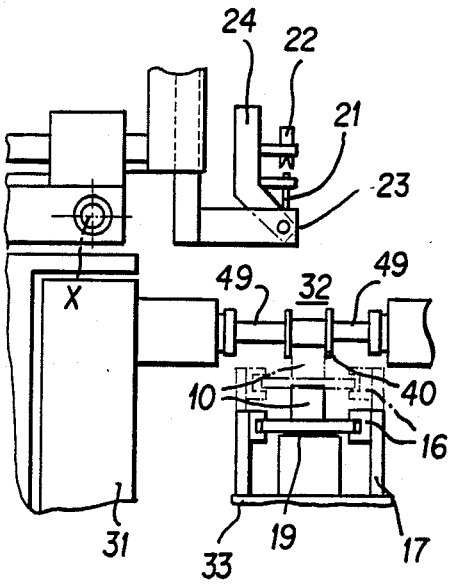
FIG. 2a
FIG 3a
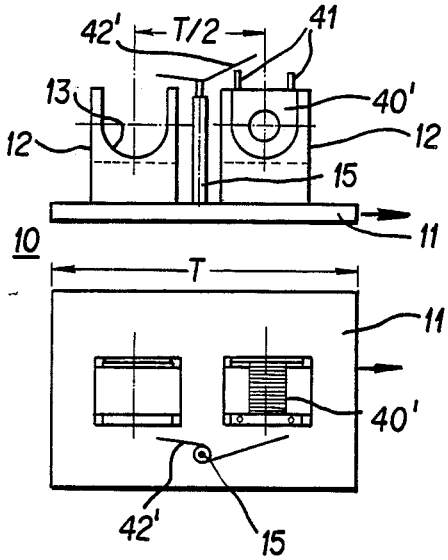
FIG. 3b

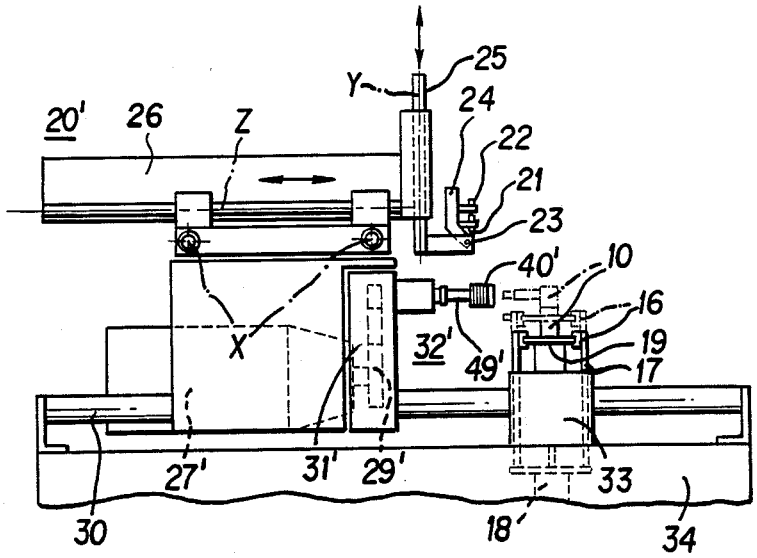
FIG. 5
FIG. 6
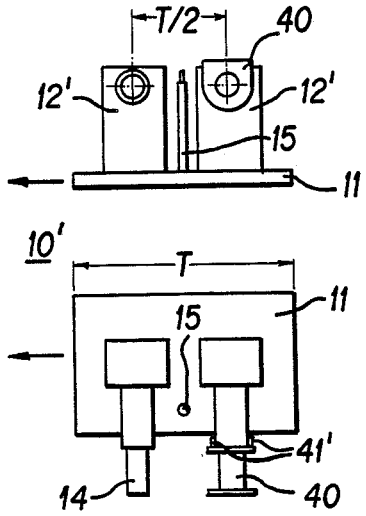
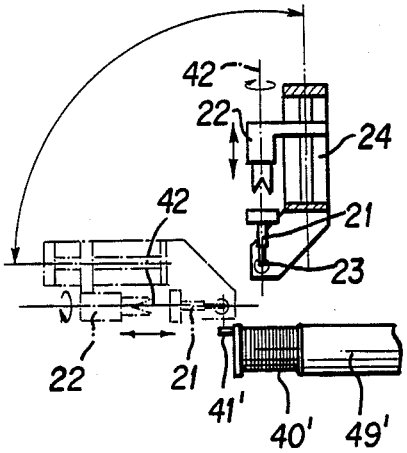
FIG. 7
FIG 6a

MULTIPLE SPINDLE WINDING MACHINE FOR ELECTRIC COILS

BACKGROUND OF THE INVENTION

This is a continuation-in-part of application Ser. No. 854,485, filed Apr. 22, 1986, now abandoned.

The present invention relates generally to a multiple spindle winding machine for electric coils. The machine includes a winding station and a conveyor belt having positioned thereon a plurality of workpiece carriers that are guided along a linear path past the winding station and a processing station.

A multiple spindle winding machine of the general type described above is described in German Patent DE P 23 63 626. The processing stations of this multiple spindle winding machine are arranged in two working planes in an over-under relationship along the direction of travel of the conveyor belt. The workpiece holding fixtures are equipped with friction coatings for holding onto the conveyor belt, particularly during the return path of the conveyor, while a corresponding frictional surface is provided on the conveyor belt. In the case of simultaneous delivery to the winding stations of, e.g., 12 coils held in workpiece holding fixtures, a certain amount of time loss in handling the coils is unavoidable, and the controlled removal of winding wire residues produced by the connection of the coil ends with the connecting pieces of the coils is not possible.

SUMMARY OF THE INVENTION

Accordingly, it is an object of the present invention to provide a multiple spindle winding machine for electric coils wherein insertion and removal, respectively, of unwound and wound coils into and from the winding station is accelerated, thereby reducing the amount of time lost in the handling of the coils.

Another object of the invention is to provide a multiple spindle winding machine for electric coils wherein the manipulation of the workpiece is rendered more universal, even for coils having very precise tolerances.

The arrangement of the present invention provides for a workpiece carrier having at least two coil holding fixtures positioned on a base plate to simultaneously remove a wound coil from the winding station, place it onto an empty coil holding fixture of the workpiece carrier and move an unwound coil into the winding station to be wound. This is attained by a longitudinal displacement of the workpiece carrier, for example, by one-half winding pitch.

Insertion of the workpiece carrier into guide rails located on the lifting device makes possible their lifting from the conveyor belt at the winding stations, whereby the handling of different coils is accomplished without special adaptation.

The invention also provides for the controlled holding and removal of winding wire residues by holding pins positioned on the workpiece carriers. The provision of holding pins also makes it possible to remove the winding wire residues by, e.g., stripping, gripping or suction after the workpiece holders pass through the winding station.

BRIEF DESCRIPTION OF THE DRAWINGS

These and other objects and advantages of the invention will become apparent from the detailed description below, when read in conjunction with the accompanying drawing figures, wherein similar parts are given similar reference numerals, and wherein:

FIG. 2 is a cross-sectional view of the winding apparatus along the line A—A of FIG. 1;

FIG. 2*a* is an enlarged detail section of the winding station illustrated in FIG. 2;

FIG. 3*a* is a lateral view of a workpiece carrier in accordance with the invention;

FIG. 3*b* is a horizontal view of a workpiece carrier in accordance with the invention;

FIG. 5 is a cross sectional view of the winding apparatus along the section line B—B of FIG. 4;

FIG. 6 is a lateral view of a workpiece carrier having arbors;

FIG. 6*a* is a horizontal view of a workpiece carrier having arbors; and

FIG. 7 is an enlarged longitudinal detail section in accordance with FIGS. 2 and 5 of a wire guide having a cutting device.

DETAILED DESCRIPTION OF THE PREFERRED EMBODIMENTS

Figure 1:
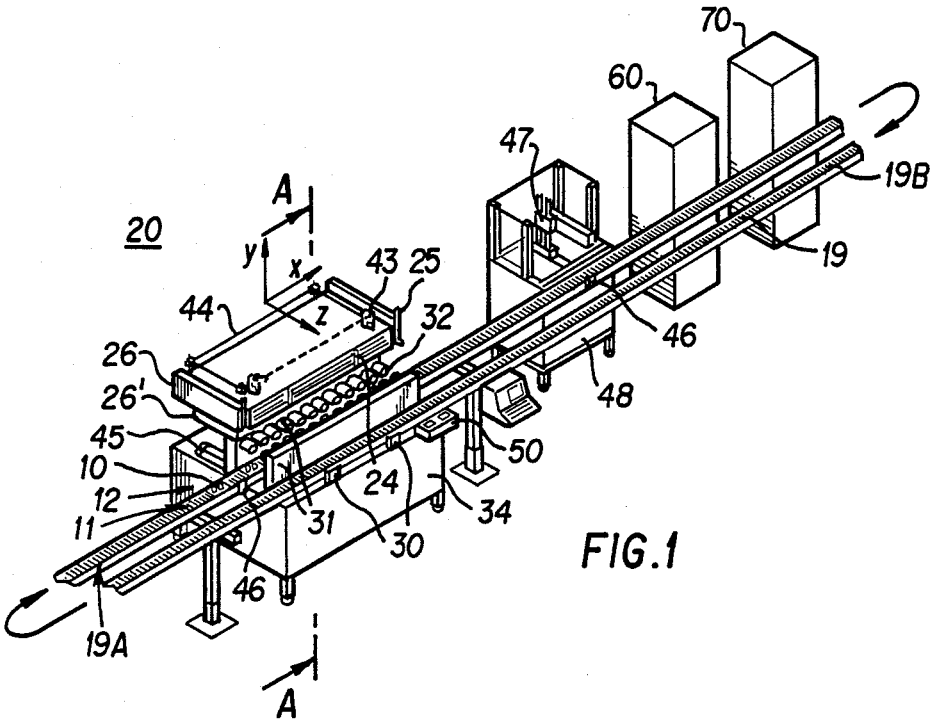
FIG. 1 is an overall perspective view of a winding apparatus according to the invention.
Figure 4:
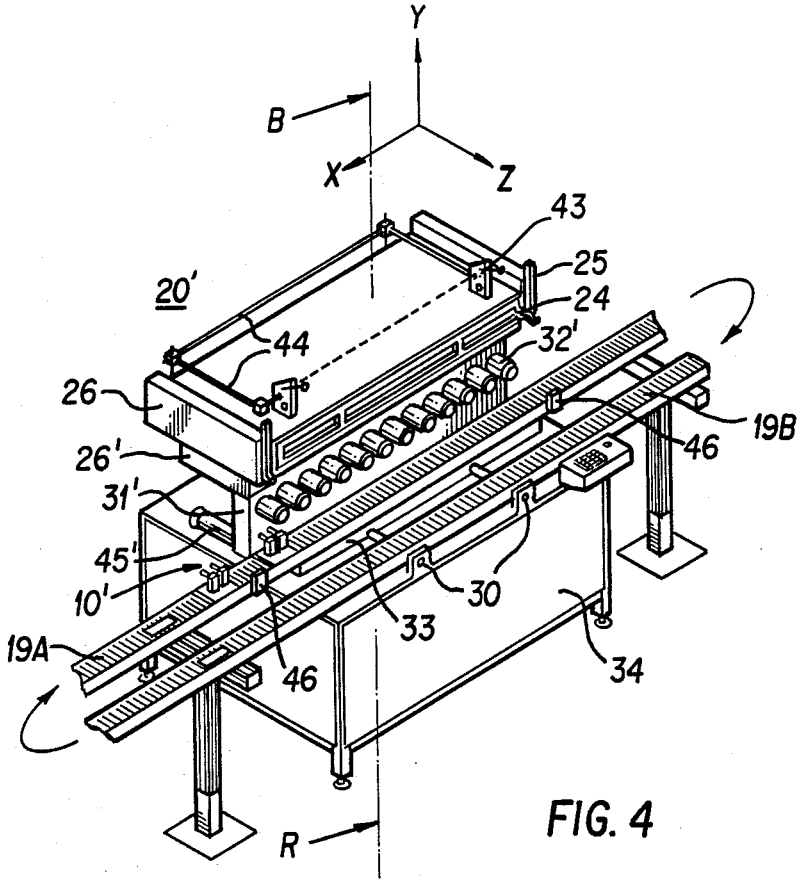
FIG. 4 provides an overall perspective view of a further embodiment of the winding apparatus according to FIG. 1.

With reference to FIGS. 1 and 4, a multiple spindle winding machine is shown having a plurality of workpiece carriers 10, 10' held by frictional forces on a conveyor belt 19 arranged to carry the workpiece carriers past a succession of processing work stations including winding apparatus 20, 20' and further work stations 60, 70 where, for example, soldering impregnating, coding and testing operations may be carried out. The workpiece carriers 10, 10', together with electric coils 40, 40' to be processed, may be arrested in processing devices or stations by means of adjustable stops 46 individually and/or in groups, or may be released for further transportation. In this manner, as workpiece carriers 10, 10' move along a path of motion on conveyor belt 19, stops 46 may be moved into and out of the path of motion to stop and position the carriers 10, 10' at the work stations, or to store the carriers 10, 10' in a waiting position.

In FIGS. 1, 1*a*, 2 and 2*a*, and in FIGS. 4 and 5, first and second preferred embodiments of a winding apparatus are designated by reference numerals 20 and 20', respectively. The winding apparatus 20, 20' are fundamentally similar in structure. However, in the winding apparatus 20, FIGS. 1, 1*a*, 2 and 2*a*, the winding stations 32 are arranged in a manner such that the coils 40, 40' to be processed are held on both sides of winding supports 31, while according to FIGS. 4, 5, 6 and 6*a*, the coils 40, 40' are placed onto arbors 14 unilaterally. Drives 27, 29, 27' and 29' of the winding stations are adapted in a manner well known in the art for operation with the respective preferred embodiments of the winding apparatus. For example, in the winding apparatus 20, FIG. 2, the drive is applied synchronously by means of clutches 28, while in the winding apparatus 20', FIG. 5, a direct drive is provided. For each winding station 32, a wire brake 43 is mounted on a linkage 44, FIGS. 1 and 4. A control panel 50 is provided on a machine stand 34 to control the operation of the winding apparatus 20, 20' in a manner well known in the art.

The winding apparatus 20, 20' includes guides 30 having winding supports 31, 31' which are longitudinally displaceable with respect to the guides 30 and the winding stations 32, 32'. Each winding station 32, 32' includes a winding tool 49, 49'. The endless conveyor belt comprises a forwardly moving flight 19A with a plurality of processing work stations including coil loading station (not shown), winding apparatus 20, 20' and further work stations 60, 70 wherein, for example, soldering impregnating, coding and testing operations may be carried out. A return flight 19B of the endless conveyor belt transports empty workpiece carriers 10,10' back to the coil loading station. The conveyor belt 19, a lifting device 17 and the guides 30 are arranged on a carrier 33. A wire guide 21 having a cutting device 22 actively connected therewith is provided for each winding station 32, 32'. Lifting device 17 is actuated by a vertically disposed pneumatic cylinder 18, see FIGS. 2 and 5. For the horizontal actuation of winding supports 31, according to FIG. 1, four pneumatic cylinders 45 are provided, of which two (shown) are located in the area of the first winding stations 32 and two (not shown) are in the area of the last winding stations 32. In the embodiment with one winding support 31', FIG. 4, only two pneumatic cylinders 45' are provided, with one of the cylinders (shown) being located in the area of the first winding stations 32' and one in the area of the last (not shown) winding stations 32'.

With reference to FIGS. 2 and 5, the wire guide 21 and associated cutting device 22 is moved by a slide 26 displaceable in the X, Y and Z axes. A fastening rail 25 having a pivot arm 24 mounted on the forward frontal side of the slide 26 carries the wire guide 21 and the cutting device 22. The slide 26 may be moved in a known manner in the X and Z axes, and additionally moved in the Y axis by the vertically displaceable fastening rail 25 together with the wire guides 21 and the cutting devices 22, the axes being freely programmable by means of a ballscrew driven dc motor, such as for example, a servomotor.

Figure 1A:
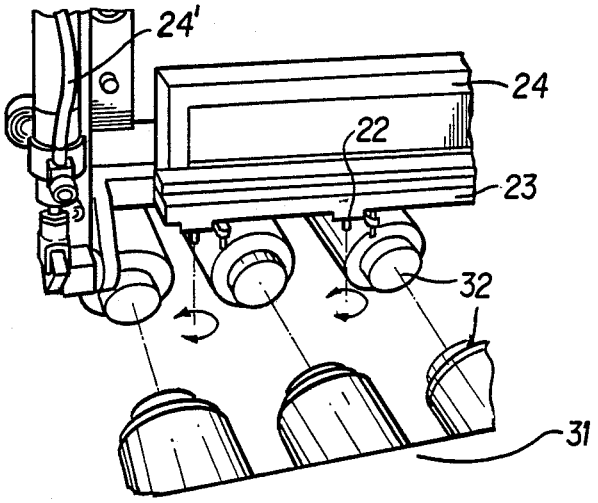
FIG. 1*a* is an enlarged perspective view of a detail in the area of the first three winding stations of the winding apparatus depicted in FIG. 1.

The pivot arm 24 may be tilted through an angle of 90° around a bearing 23, FIGS. 1*a* and 7. The cutting device 22 is additionally displaceable in a manner parallel in relation to the wire guide 21 and may be rotated around its vertical axis. The cooperation of the wire guide 21 with the cutting device 22 provides for universal processing of winding wire ends having a variety of coil configurations, even those configurations including radially and axially mounted connecting pieces, 41, 41', respectively. The coil 40' is wound by displacement of the slide 26 on a slide table 26' together with the wire guide 21 in the Z axis, with the winding wire 42, FIG. 7, being supplied from a storage coil (not shown).

Each of the workpiece carriers 10, 10' shown in FIGS. 3, 3*a*, 3*b* and FIGS. 6, 6*a* includes a base plate 11 held on the conveyor belt 19 by frictional forces and at least two spaced apart coil holding fixtures 12, 12', each coinciding with a winding station 32, 32' of the winding apparatus 20, 20'. A holding pin 15 is positioned between the coil holding fixtures 12, 12' for taking up winding wire residues 42'. The residues are taken up during the transfer of the unwound coil 40 from the coil holding fixture 12, 12' to the winding station 32, 32', or correspondingly from the wound coil 40'. The length of the base plate 11 corresponds to the winding station partial pitch T of the winding apparatus 20, 20'. During the introduction of the workpiece carriers 10, 10' into the winding apparatus 20, 20', the base plate 11 of the workpiece carrier 10, 10' is inserted into the guide rails 16 located laterally in relation to the conveyor belt 19 of the lifting device 17 so that each workpiece carrier 10, 10' is raised from the conveyor belt 19 to the winding stations 32, 32'. The coils 40 carried in the coil holding fixtures 12, 12' are held on both sides in the winding station in accordance with the apparatus depicted in FIGS. 1, 2 and may be inserted into the respective apparatus depicted in FIGS. 4, 5. In an automated process, a plurality of workpiece carriers 10, 10' is raised simultaneously to the winding stations 32, 32'.

Figure 3:
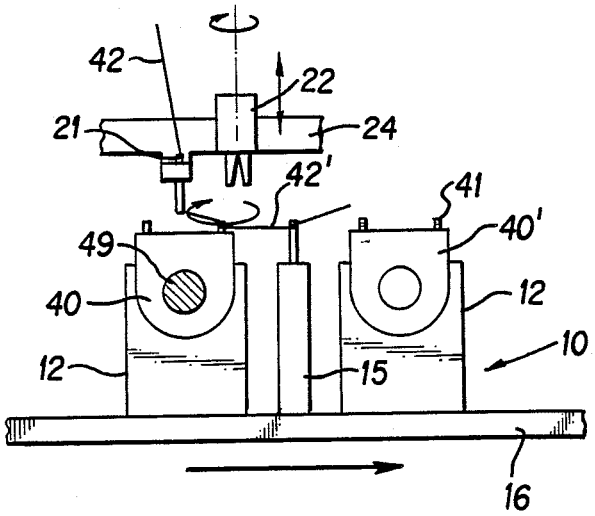
FIG. 3 is a side view illustrating an embodiment of a workpiece carrier and an adjacent winding station.

The coil holding fixtures 12 of the workpiece carrier 10 depicted in FIGS. 3, 3*a* and 3*b* include, for example, semicircular coil bearings 13 open at the top, into which the coils 40, 40' may be inserted or from which they may be removed. The coil holding fixtures 12' of the workpiece carrier 10' illustrated in FIGS. 6 and 6*a* are in the form of arbors 14 making possible the unilateral insertion of the coils 40.

As shown in FIGS. 3, 3*a* and 3*b*, a previously wound coil 40' is positioned in a first coil holding fixture 12 in the direction of transport of the workpiece carrier 10, the cut winding wire residue 42' thereof being held on the holding pin 15. FIG. 2 depicts an unwound coil 40 already having been removed from a coil holding fixture adjacent to the first fixture and second in the direction of transport. The unwound coil is shown after it has been inserted into the winding station 32, with its winding start fastened to the connection piece 41 and the cut winding wire residue 42' held by the holding pin 15. The interconnected winding wire residues 42' held by the holding pin 15 are removed outside the winding stations 32, as by stripping, gripping or suction from the holding pin 15.

The workpiece carriers 10' depicted in FIGS. 6 and 6*a* are of similar configuration to those depicted in FIGS. 3, 3*a* and 3*b* with the exception that arbors 14 are provided in place of the coil bearings 13. The coil holding fixture 12' first in the direction of transport is empty, the unwound coil 40 being in the second coil holding fixture and the wound coil 40' being in the corresponding winding station 32'.

In FIGS. 1, 3, 3*a* and 3*b*, the workpiece carrier 10 is raised into the winding installation 20, wherein the already wound coil 40' is placed into the coil receiver 12 and the winding wires 42 are twisted immediately onto the radially extending connecting pieces 41 and the holding pin 15, and cut off at the connecting pieces 41. Following the shifting of the bobbin 10 by one-half the winding station division T/2, the winding tools 49 move from both sides into the unwound coil 40, as shown in FIG. 3. The wire guide 21 with the cutting device 22, winds the winding wire 42 onto the connecting piece 41 and the unwound coil 40 remains in the winding installation 20, to be wound. The bobbin 10, with the already wound coil 40' is lowered onto the conveyor belt 19, as shown in FIGS. 3*a* and 3*b*. The winding wire residues 42' held on the holding pin 15 are cut unilaterally according to FIG. 3 (according to FIG. 3*a* and 3*b* they are already cut on both sides) and the winding wire residues 42' are removed to a station 47 located outside the winding installations 20, 20', to remove the wire residues 42' from the holding pin 15 and collect them in a container 48. The winding wire residues 42' may also be removed after passing the winding stations 32, 32' in the station 47, for example, by stripping, gripping or suctioning from the holding pin 15.

FIG. 7 shows the wire guide 21 mounted on the pivot arm 24, together with the cutting device 22, wherein the winding position is indicated by solid lines and the position for processing the winding ends, which position is illustrated as being tilted by 90° on the axially arranged connecting piece 41' of the coil 40' and displaced toward the connecting piece 41', is shown by broken lines. The cutting device 22 may be brought into any cutting position desired, as it may be displaced additionally in a parallel manner with respect to the wire guide 21 and rotated around its vertical axis. This assures the satisfactory processing of the winding ends in relation to the connecting pieces 41, 41'.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the attached claims.

What is claimed is:

1. A multiple spindle winding machine for electric coils comprising:

a winding station;

a processing station;

a conveyor belt having a plurality of workpiece carriers, said conveyor belt being arranged to sequentially transport said workpiece carriers to said winding station and said processing station along a substantially linear path, a plurality of stops being movable into and out of said path to selectively arrest at least one of said plurality of workpiece carriers, each of said plurality of workpiece carriers including a base plate for frictionally engaging said conveyor belt, at least two spaced apart coil holding fixtures rigidly secured to said base plate and cooperable with said winding station, and a holding pin positioned between said at least two coil holding fixtures; and a lifting device having guide rails laterally displaced from said conveyor belt, said base plate being receivable by said guide rails for elevating at least one of said plurality of workpiece carriers from said conveyor belt to said winding station, said winding station having a pivotable arm, said pivotable arm having a wire guide and a cutting device mounted thereto for providing wire to be wound around a coil, residue wire being collected by said holding pin.

2. The multiple spindle winding machine of claim 1, wherein said at least two coil holding fixtures include coil bearings open along an upper surface.

3. The multiple spindle winding machine of claim 1 wherein each of said at least two coil holding fixtures includes an arbor for receiving said coil.

4. The multiple spindle winding machine of claim 1, wherein said pivot arm is tiltable through an angle of approximately 90°.

5. A multiple spindle winding machine for electric coils, with a plurality of winding stations and a conveyor belt comprising revolving workpiece carriers guided along a path of motion along said belt to processing stations adjacent the winding stations, wherein the workpiece carriers are automatically stopped, positioned and released at the processing stations, said stations being located in a working plane and with stops being provided for the automatic stopping positioning, said stops being movable into and out of said path of motion, wherein each workpiece carrier includes a base plate frictionally connected with the conveyor belt, at least two coil bobbins rigidly connected with said plate and spaced apart to coincide with the winding stations, a holding pin between the two coil bobbins for winding wire residues, each of said winding stations having a pivoting arm, said pivoting arm having a wire guide and an associated cutting device, the holding pin cooperating with the pivoting arm, the wire guide, and the associated cutting device, before and after winding, and each of said winding stations having a lifting means for lifting the workpiece carriers off of the conveyor belt.

* * * * *